US005457926A

United States Patent [19]

Jensen

[11] Patent Number: 5,457,926

[45] Date of Patent: Oct. 17, 1995

[54] INTERLOCKING BLOCK

[75] Inventor: Daniel M. Jensen, Phoenix, Ariz.

[73] Assignee: Templeton Trust, Salt Lake City, Utah

[21] Appl. No.: 147,137

[22] Filed: Nov. 3, 1993

[51] Int. Cl.[6] ..... E04C 2/20; E04C 2/30

[52] U.S. Cl. ..... 52/604; 52/309.4; 52/503; 52/570; 52/592.3; 52/605; 52/606

[58] Field of Search ..... 52/309.1, 309.4, 52/561, 569–572, 604–606, 592.1–592.3, 592.6, 503

[56] References Cited

U.S. PATENT DOCUMENTS

| | | | |
|---|---|---|---|
| 460,177 | 9/1891 | Cook . | |
| 786,884 | 4/1905 | Faulkner . | |
| 800,385 | 9/1905 | Miller | 52/503 |
| 1,418,168 | 5/1922 | Preston . | |
| 1,516,473 | 11/1924 | Davis | 52/592.1 |
| 3,618,279 | 11/1971 | Sease | 52/592.3 X |
| 4,475,326 | 10/1984 | Hanson | 52/286 |
| 5,024,035 | 6/1991 | Hanson | 52/591 |
| 5,226,275 | 7/1993 | Trahan | 52/592.6 |

FOREIGN PATENT DOCUMENTS

| | | | |
|---|---|---|---|
| 2508956 | 1/1983 | France | 52/561 |
| 2509344 | 1/1983 | France | 52/561 |
| 536102 | 5/1984 | France | 52/561 |
| 0000198 | 4/1979 | WIPO | 52/606 |
| 8401594 | 4/1984 | WIPO | 52/561 |

*Primary Examiner*—Carl D. Friedman
*Assistant Examiner*—Robert J. Canfield
*Attorney, Agent, or Firm*—Tod R. Nissle

[57] ABSTRACT

Lightweight foam building blocks simplify the interlocking of the blocks when the blocks are being stacked, increase the resistance of the blocks to rotational forces which twist one block with respect to another, and decrease the passage of air and light intermediate interlocking block pairs.

5 Claims, 4 Drawing Sheets

INTERLOCKING BLOCK

This invention relates to interlocking building blocks.

More particularly, the invention relates to lightweight, non-cementitious, resilient, plastic foam building blocks which simplify the interlocking of the blocks when the blocks are being stacked, which significantly increase the resistance of the blocks to rotational forces which twist one block with respect to another, and which decrease the passage of air and light through spaces in interlocking block pairs.

Many patents exist which describe and claims lightweight interlocking foam building blocks. See, for example, U.S. Pat. Nos. 5,024,035 to Hanson et al. and 4,475,326 to Hanson. Certain disadvantages are typically associated with such blocks. First, when walls are constructed of the blocks, light, and consequently air, passes intermediate the blocks reducing the efficiency of the wall in producing a tight, insulating wall. After such walls are assembled, the builder can stand back and visually ascertain light passing through small spaces in the wall. Second, even though the blocks interlock, they are susceptible to movement when one block is rotated with respect to another about a vertical axis. This reduces the structural integrity and stability of the block structure. Third, when an attempt is made to manufacture blocks to close tolerances to obtain a tight interlock between adjoining blocks, the friction generated by such a tight interlock makes interlocking of the blocks difficult.

Accordingly, it would be highly desirable to produce an improved lightweight interlocking foam building block which prevented the passage of light intermediate adjoined blocks, which prevented rotation slack or movement between stacked block pairs, and which facilitated the readily assembly and interlocking of block pairs.

Therefore, it is a principal object of the invention to provide an improved interlocking block.

Another object of the invention is to provide a lightweight, non-cementitious, resilient, plastic foam block which can be assembled with other like blocks to produce a light impervious wall.

A further object of the invention is to provide a lightweight foam blocks which facilitates the ready interlocking of the block with like blocks and which eliminates or substantially minimizes rotational movement of one block with respect to another.

These and other, further and more specific objects and advantages of the invention will be apparent to those skilled in the art from the following detailed description thereof, taken in conjunction with the drawings, in which.

Figure 1:
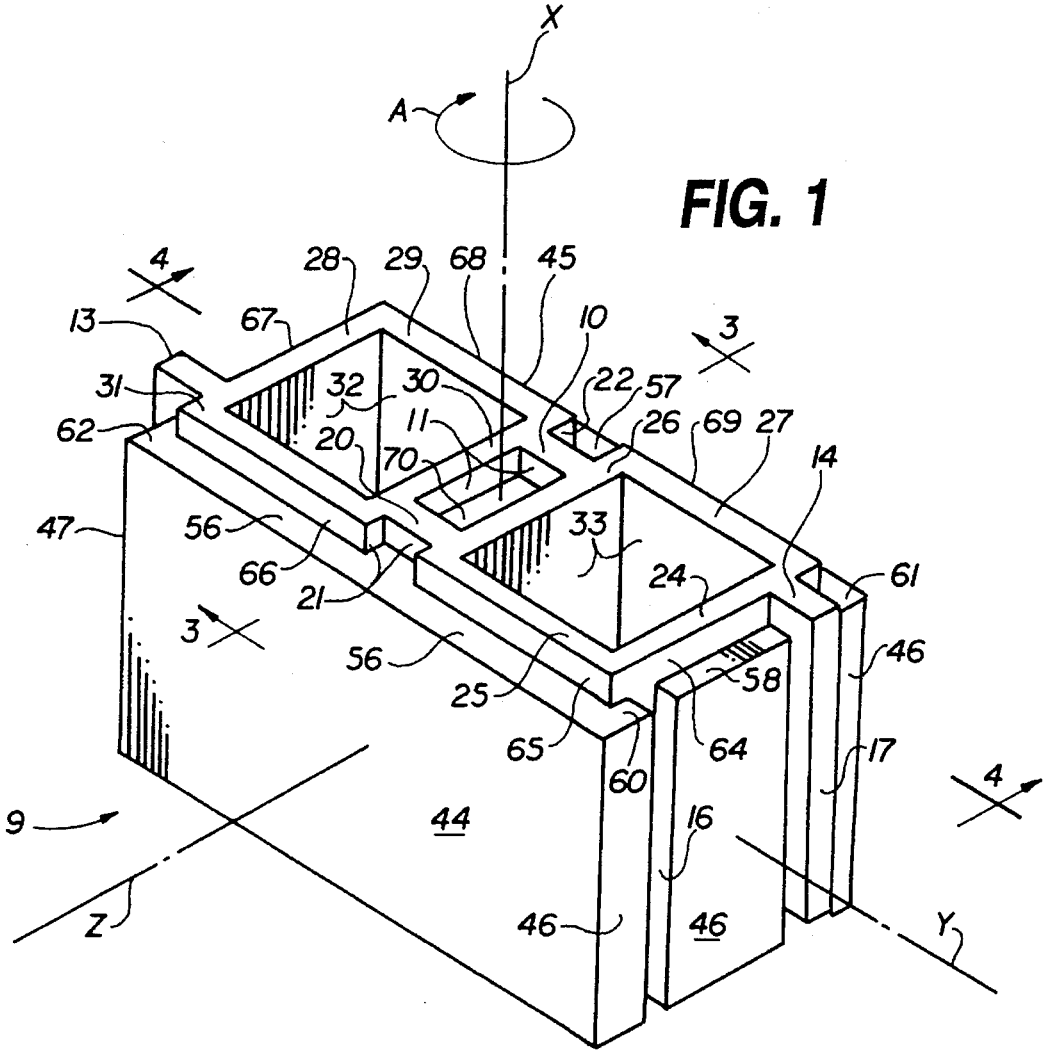
FIG. 1 is a perspective view illustrating an interlocking building block constructed in accordance with the principles of the invention.
Figure 2:
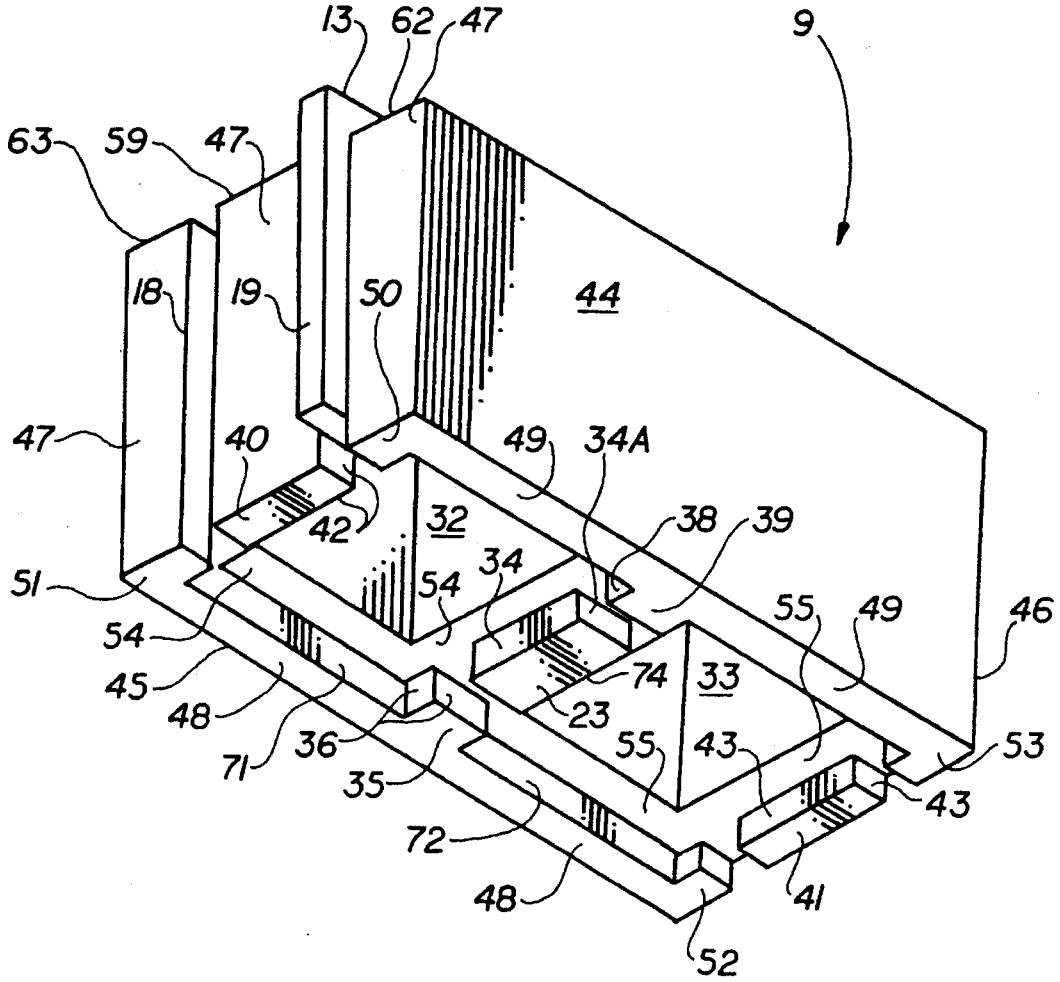
FIG. 2 is a perspective view of the block of FIG. 1 further illustrating construction details thereof.
Figure 3:
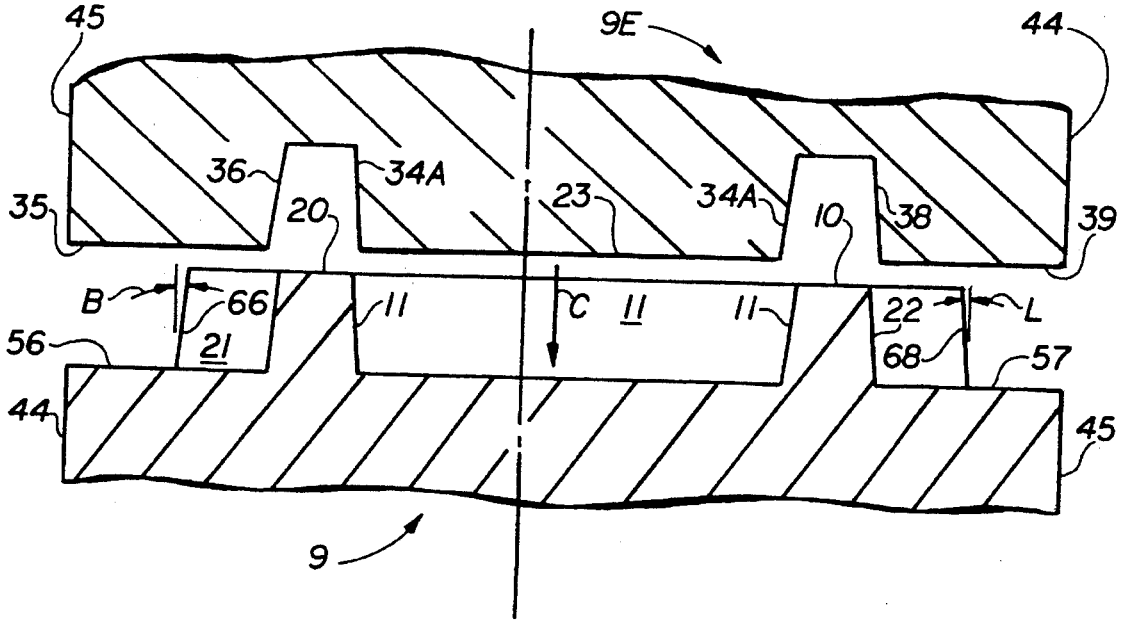
Figure 4:
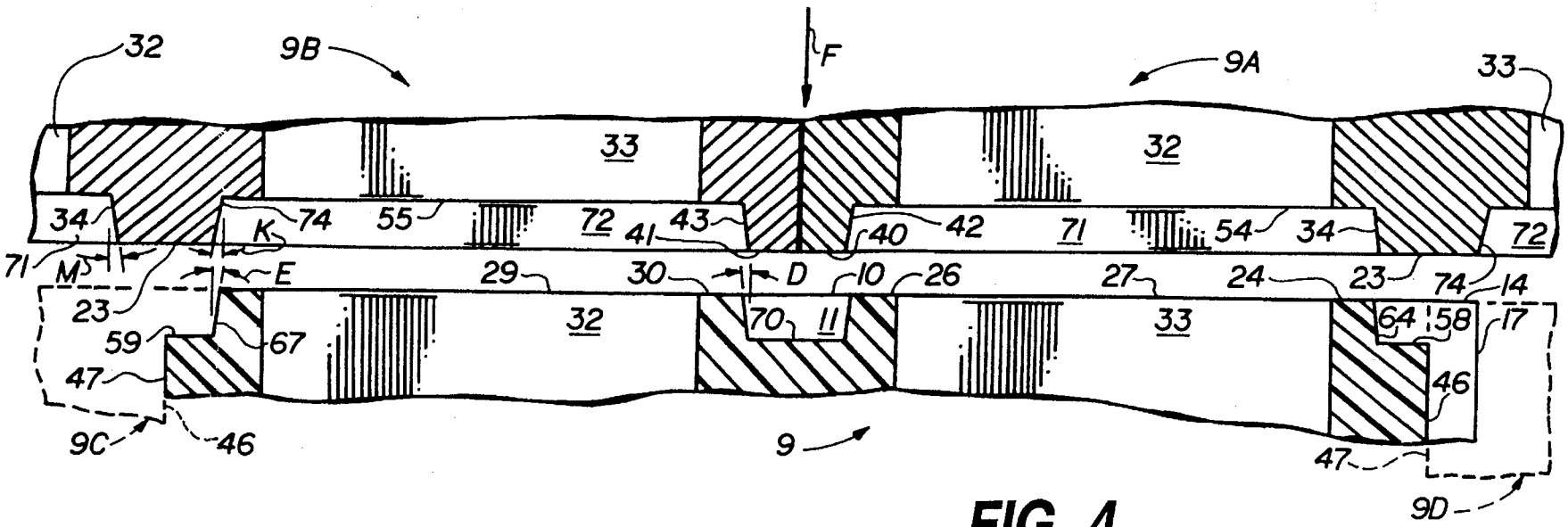

FIG. 3 is a partial section view of the block of FIG. 1 taken along section line 3—3 thereof and illustrating the adjoining of the block with another like block stacked squarely on top of the block of FIG. 1; and, FIG. 4 is a partial section view of the block of FIG. 1 illustrating the adjoining of the block with other like blocks stacked on top of and longitudinally offset from the block by one-half the length of the block.

Briefly, in accordance with my invention, I provide an interlocking block comprising a pair of spaced sidewalls; first and second end walls joining the sidewalls and spaced from each other; an upper surface; and, a lower surface. The end walls each have respective first and second end faces.

Each end face of the block carries vertically aligned spaced apart tongue and groove pair. The tongue and groove pair on the first end is positioned to be complementary to and engage a respective groove and tongue pair on an abutting end face of an identical block that is longitudinally aligned with the building block. The upper surface carries a pair of vertically extending projections and adjoining vertical recesses. The projections are adjoined by a pair of webs. The webs extend longitudinally across the upper surface. The vertically extending projections and the webs define a four sided enclosed recess centrally positioned on the upper surface. The lower surface has a pair of recesses shaped and positioned so that one of the pair of projections on the upper surface is complementary to and engages one of the pair of recesses on an abutting surface of an identical block that is longitudinally offset by one-half the length of the block. A four-side outward projection is centrally positioned on the lower surface and shaped such that the projection is complementary to and engages the enclosed recess on the upper surface of an identical block that is set squarely on the building block.

In another embodiment of the invention, I provide an interlocking building block comprising a pair of spaced sidewalls; first and second end walls joining said sidewalls and being spaced from each other; an upper surface; and a lower surface. The first end wall has a first end face. The second side wall has a second end face. Each end face carries a vertically aligned spaced apart tongue and groove pair. The tongue and groove pair on the first end is positioned and shaped to be complementary to and engage a respective groove and tongue pair on an abutting end face of an identical block that is longitudinally aligned with the building block. The upper surface joins the side walls and carries outwardly extending projections each including at least one vertically oriented planar surface having a proximate portion adjacent the upper surface and a distal portion spaced away from the upper surface. Each of the projections is spaced inwardly from and adjacent one of the sidewalls and the end walls and is canted away from said one of the sidewalls and end walls toward a vertical axis through the center of the building block and adjoining vertical recesses such that the distal portion is closer to the vertical axis than the proximate portion. The projections are adjoined by a pair of vertically extending webs. The webs extend longitudinally across the upper surface. The vertically extending projections and the webs defining and enclosing a recess centrally positioned on the upper surface. The lower surface has recesses each having at least one vertically oriented planar surface having a lower portion adjacent the lower surface and an upper portion spaced apart from the lower surface. The planar surfaces are each canted such that the upper portion is closer to the vertical axis than the lower portion. The planar surfaces of the recesses are each shaped and positioned so that each one of the outwardly extending projections on the upper surface is complementary to and engages one of the recesses on an abutting surface of an identical block that is longitudinally offset by one-half the length of the block.

Turning now to the drawings, which depict the presently preferred embodiment of the invention for the purpose of illustrating the practice thereof and not by way of limitation of the invention, and in which like reference characters refer to corresponding element throughout the several views, FIGS. 1 to 4 illustrate an interlocking building block generally indicated by reference character 9 and constructed in accordance with the principles of the invention. Block 9 includes spaced apart side walls 44 and 45. A first end wall and second end wall each extend between and join sidewalls 44 and 45. The first end wall includes planar face 46. The second end wall includes planar face 47. Each face 46 and 47 carries a vertically aligned spaced apart tongue and groove pair. Face 46 carries a tongue having upper horizontally oriented contact surface 14 parallel to longitudinal axis Y and a vertically oriented contact surface 17 parallel to vertical axis X. Face 46 also carries vertically oriented groove 16. Face 47 carries an outwardly projecting tongue having upper horizontally oriented contact surface 13 parallel to longitudinal axis Y and a vertically oriented contact surface 19 parallel to vertical axis X. Face 47 also carries vertically oriented groove 18. Groove 16 and its associated tongue on face 46 are positioned and shaped to be complementary to and engage a groove and tongue pair on an abutting end face of an identical block that is longitudinally aligned with block 9. For example, groove 16 receives contact surface 19 and groove 18 receives contact surface 17 when a pair of identical blocks are longitudinally aligned and interlocked such that faces 46 and 47 contact. Similarly, groove 16 on a first block receives surface 17 on a second block and groove 16 on the second block receives surface 17 on the first block when the blocks are longitudinally aligned and interlocked such that faces 46 contact.

Block 9 includes an upper surface including planar surfaces 56, 70, 60, 58, 61, 59, 62, 63. A pair of square shaped vertical projections are carried on the upper surface of block 9. The first vertical projection includes canted vertically oriented planar surfaces 66, 67, 68 and upper horizontally oriented planar surfaces 28, 29, 30, and 31. The second vertical projection includes canted vertically oriented planar surfaces 64, 65, 69 and upper horizontally oriented planar surfaces 24, 25, 26, 27. A pair of spaced apart vertically extending webs interconnect the first and second vertical projections. The first of the web pair includes upper horizontally oriented surface 10. The second of the web pair includes upper horizontally oriented surface 20. The first web and the first and second projections cooperatively define a U-shaped indent or recess having vertically oriented, canted, surface 22. The second web and the first and second projections cooperatively define a U-shaped indent or recess having vertically oriented, canted surface 21. Both webs and the first and second projections define a rectangular four-sided indent or recess having vertically oriented, canted surface 11 defining the perimeter of the recess. Planar surface 70 is the floor of the four-sided recess.

Block 9 includes a lower surface including planar surfaces 50, 51, 40, 49, 53, 41, 52, 48, 35, 39. U-shaped surface 42 extends partially around and depends downwardly from surface 40. U-shaped surface 43 extends partially around and depends downward from surface 41. A pair of square shaped vertical recesses are carried on the lower surface of block 9. The first vertical recess includes canted vertically oriented planar surfaces 71, 36, 34, 38, and horizontally oriented square-shaped planar floor surface 54. Surfaces 34A extend between surfaces 34 and 74. The second vertical recess includes canted vertically oriented planar surface 72 and horizontally oriented square-shaped planar floor surface 55. Each of the vertical recesses on the lower surface of block 9 is complementary to and can receive either one of the square-shaped vertical projections on the upper surface of block 9. If, for example, a first block 9 is on top of a second block 9 and is longitudinally offset by one-half the length of the first block, the vertical projection with surface 24, 25 fits into the recess with floor 54 such that surfaces 24, 27, 26 and 25 contact floor 54, such that surface 69 contacts and complements surface 71, and such that surface 64 contacts surface 34, one of surface 36, and one of vertical surfaces 38. Similarly the projection with surface 23 complements and interfits with the four-sided recess on the upper surface of block 9 such that surfaces 34, 34A, 74 contact and oppose surface 11 and such that surface 23 contacts surface 70.

In FIG. 3 one block 9E is stacked squarely on top of another identical block 9 such that the face 46 of block 9 lies in a common vertical plane with the face 46 of block 9A.

In use, in FIG. 4 a wall structure is constructed by stacking each of a pair of blocks 9A and 9B on top of and longitudinally offset from an underlying block 9 by one-half the length of blocks 9A and 9B in the conventional fashion utilized in building a wall. Additional footing blocks 9C and 9D are abutted to each end of block 9. Blocks 9, 9A, 9B, 9C, and 9D can each be secured to abutting blocks with adhesive or any other means. Concrete and re-bar can extend through hollows in the blocks in conventional fashion.

When a pair of identical blocks 9, 9C are longitudinally aligned such that the end surface 47 of one block 9 contacts the end surface 46 of the other block 9C and such that the upper surfaces 56, 57 of the blocks are coplanar, then surfaces 64 and 58 of one block 9C and surfaces 59 and 67 of the other block 9 cooperate, along with the upper portions of the tongues extending from surfaces 46 and 47 (the tongues includes upper surface 14 and 13, respectively) to form a secondary recess which has a shape and dimension equal to that of the recess circumscribed by rectangular surface 11. The secondary recess is bounded by portions of surfaces 64 and 67 and, as illustrated in FIG. 4, receives and interlocks with the projection which is on the lower surface of a block 9B which is stacked on top of blocks 9 and 9C. The projection which is received by the secondary recess includes horizontally oriented surface 23 and canted vertical surfaces 34, 34 and 74.

A pair of spaced apart vertically extending U-shaped members or projections extend inwardly toward the vertical axis X of block 9. The first U-shaped member includes vertically oriented canted U-shaped wall 38 and horizontal surface 39. The second U-shaped member includes vertically oriented canted U-shaped wall 36 and horizontal surface 35. The first U-shaped member is complementary to and interfits with either of the U-shaped grooves on the upper surface. One of the U-shaped grooves or recesses on the upper surface includes vertical face 22; the other recess on the upper surface includes vertical face 21. Vertical face 38 is complementary to and can interfit with face 22 or 21. U-shaped vertical face 36 is complementary to and can interfit with face 22 or 21.

In FIG. 4, vertically oriented planar surfaces 34, 42, 43, 67, 11, 71, 72, 74, and 64 are canted from the vertical an amount in the range of one degree to twenty degrees, preferably about five to eight degrees. The cant of surface 67 from the vertical is indicated by arrows E in FIG. 4. The cant of surface 11 from the vertical is indicated by arrows D in FIG. 4. The cant of surface 74 from the vertical is indicated by arrows K in FIG. 4. The cant of surface 34 from the vertical is indicated by arrow M.

In FIG. 3, the cant of surface 66 from the vertical is indicated by arrows B and is in the range of one degree to twenty degrees. The cant of surface 68 from the vertical is indicated by arrows L and is in the range of one degree to twenty degrees.

Having described my invention in such terms as to enable those skilled in the art to understand and practice it, and having identified the presently preferred embodiments thereof, I claim:

1. An interlocking building block comprising (a) a pair of spaced sidewalls, and (b) first and second opposite end walls joining said sidewalls and being spaced apart from each other, said end walls each having respective first and second end faces, each end face of said block carrying a vertically aligned spaced apart tongue and groove pair, said tongue and groove pair on said first end face further being positioned to be opposite and complementary to said tongue and groove pair on said second end face;

(c) an upper surface carrying a pair of vertically extending projections and a pair of vertical recesses, said projections being adjoined by a pair of webs, said webs extending longitudinally across said upper surface, said vertically extending projections and said webs defining a four sided enclosed recess centrally positioned on said upper surface;

(d) a lower surface opposite said upper surface and having a pair of recesses shaped and positioned so that one of said pair of projections on said upper surface is complementary to one of said pair of vertical recesses on said lower surface; and, (e) a four sided outward projection centrally positioned on said lower surface and shaped such that said projection is opposite and complementary to said enclosed recess on said upper surface of said building block.

2. An interlocking building block having a center and a vertical axis passing through said center, said block comprising (a) a pair of spaced sidewalls;

(b) first and second opposite end walls joining said sidewalls and being spaced apart from each other, said end walls having respective first and second end faces, each of said end faces of said block carrying a vertically aligned spaced apart tongue and groove pair, said tongue and groove pair on said first end face further being positioned to be opposite and complementary to said tongue and groove pair on said second end face;

(c) an upper surface carrying outwardly extending projections and at least one vertical recess adjoining said projections, said projections each including at least one planar surface having a proximate portion adjacent said upper surface and a distal portion spaced away from said upper surface, each of said projections spaced inwardly from said sidewalls and said end walls and each of said planar surfaces canted (i) toward one of walls in the group consisting of
said sidewalls, and
said end walls, and (ii) away from said vertical axis such that said distal portion is further from said vertical axis then said proximate portion, said projections being adjoined by a pair of vertically extending webs, said webs extending longitudinally across said upper surface, said outwardly extending projections and said webs defining an enclosed recess centrally positioned on said upper surface;

(d) a lower surface opposite said upper surface and having recesses each having et least one planar surface having an outer portion adjacent said lower surface and an inner portion spaced inwardly apart from said lower surface, said planar surface of each of said recesses on said lower surface being (i) canted such that said outer portion is closer to said vertical axis than said inner portion and (ii) shaped and positioned to complement one of said planar surfaces of said outwardly extending projections on said opposite upper surface.

3. The building block of claim 1, wherein said block is comprised of lightweight, non-cementitious, plastic foam material.

4. The building block of claim 2, wherein said block is comprised of lightweight, non-cementitious, plastic foam material.

5. An interlocking building block having a center and a vertical axis passing through said center, said block comprising (a) a pair of spaced sidewalls;

(b) first and second opposite end walls joining said sidewalls and being spaced apart from each other, said end walls having respective first and second end faces, each end face of said block carrying a vertically aligned spaced apart tongue and groove pair, said tongue and groove pair on said first end face further being positioned to be opposite and complementary to said tongue and groove pair on said second end face;

(c) an upper surface carrying outwardly extending projections and at least one vertical recess adjoining said projections, said projections each including at least one planar surface having a proximate portion adjacent said upper surface and a distal portion spaced away from said upper surface, each of said projections spaced inwardly from said sidewalls and said end walls and each of said planar surfaces canted (i) away from one of the walls in the group consisting of
said sidewalls, and
said end walls, and (ii) toward said vertical axis and adjoining vertical recess such that said distal portion is closer to said vertical axis than said proximate portion, said projections being adjoined by a pair of vertically extending webs, said webs extending longitudinally across said upper surface, said outwardly extending projections and said webs defining an enclosed recess centrally positioned on said upper surface;

(d) a lower surface opposite said upper surface and having recesses each having at least one planar surface having an outer portion adjacent said lower surface and an inner portion spaced inwardly apart from said lower surface, said planar surface of said recess on said lower surface being (i) canted such that said outer portion is further from said vertical axis than said inner portion, and shaped and positioned to complement one of said planar surfaces of said outwardly extending projections on said upper surface.

* * * * *